United States Patent [19]

Fukui

[11] 4,395,034

[45] Jul. 26, 1983

[54] SHEET FEEDING DEVICE

[75] Inventor: Kazuyuki Fukui, Toyokawa, Japan

[73] Assignee: Minolta Camera Kabushiki Kaisha, Osaka, Japan

[21] Appl. No.: 260,647

[22] Filed: May 4, 1981

[30] Foreign Application Priority Data

May 9, 1980 [JP] Japan ..... 55-62084

[51] Int. Cl.[3] ..... B65H 3/30

[52] U.S. Cl. ..... 271/21

[58] Field of Search ..... 271/21, 22, 19–25

[56] References Cited

U.S. PATENT DOCUMENTS

| | | | |
|---|---|---|---|
| 1,960,482 | 5/1934 | Duncan | 271/22 X |
| 3,278,181 | 10/1966 | Fengler | 271/22 |
| 3,497,206 | 2/1970 | Tippy | 271/21 X |
| 3,647,204 | 3/1972 | Sato | 271/117 |

FOREIGN PATENT DOCUMENTS 53-100688 8/1978 Japan .

55-23352 2/1980 Japan .

*Primary Examiner*—Richard A. Schacher

*Attorney, Agent, or Firm*—Wolder, Gross & Yavner

[57] ABSTRACT

A sheet feeding device comprises a cassette for holding a stack of sheets, feeding means for longitudinally advancing the uppermost sheet of the stack from the cassette in pressing contact with the sheet at approximately the longitudinal medial axis of the sheet with respect to the feeding direction, separating pawl members for separating the uppermost sheet from the other sheets by engaging the uppermost sheet at its leading opposite corners to thereby temporarily restrain the uppermost sheet from advancing, and pressure members for pressing the uppermost sheet at its opposite side portions to a predetermined extent. The pressure members are retractable from the pressing position in accordance with the resilient force of the sheet when the advancing sheet is buckled by engagement with the separating pawl members.

15 Claims, 4 Drawing Figures

SHEET FEEDING DEVICE

BACKGROUND OF THE INVENTION

The present invention relates to improvements in sheet feeding devices for copiers, printers and other equipment, and it relates more particularly to an improved sheet feeding device for successively dispensing individual sheets from a cassette containing a stack of the sheets.

Separating pawl members are usually used for dispensing individual flexible copy sheets from a stack of the sheets. When the uppermost sheet of the stack starts to advance under the action of a feeding member, the separating pawl members engage the sheet at the opposite corners of its leading end and temporarily restrain the sheet from advancing to bend or buckle the sheet, causing the uppermost sheet only to pass over the pawl members under the influence of the resilient force of the sheet resulting from the bending.

Although the buckled form of the sheet varies with the material and thickness of the sheet and with the distance between the feeding member and the separating pawl members, the sheet will be discharged obliquely or along with another sheet, or will fold or wrinkle when not deformed to the shape required for the sheet to pass over the pawl members.

There is described in U.S. Pat. No. 3,647,204, issued Mar. 7, 1972 to J. Sato, an arrangement for bending sheets of different sizes to approximately the same shape, which arrangement includes pairs of rollers serving as feeding members and being fixedly mounted on a shaft, each pair of rollers being positionable at a substantially constant distance from separating pawl members when the pawl members are shifted for sheets of different sizes. Thus, the mechanism described in the aforesaid patent to Sato functions to assure an approximately constant bent form for sheets of different sizes but does not so function for sheets of different physical qualities or thicknesses.

On the other hand, the sizes of sheets vary from country to country. In Japan and West Germany, for example, sheets of sizes in A and B series are usually used, while in the U.S. sheets of letter size, legal size and computer size are generally employed. As a consequence, even when copiers of the same type are manufactured, sheet feeding mechanisms, which differ in the arrangement of the rollers for use in different countries, must be provided in the Sato device in accordance with the sheet sizes used in the respective country. Accordingly, several different feeding mechanisms must be designed and fabricated, leading to a significant cost increase and necessitating a complex assembling procedure.

SUMMARY OF THE INVENTION

The main object of the present invention is to provide an improved device for properly feeding individual sheets from a stack thereof.

Another object of the invention is to provide an improved sheet feeding device free of the drawbacks of the earlier devices.

Still another object of the invention is to provide a universally applicable sheet feeding device which is capable of properly and uniformly feeding sheets of a wide range of sizes and properties.

The above and other objects of the present invention will become apparent from a reading of the following description taken in conjunction with the accompanying drawings which illustrate preferred embodiments thereof.

A sheet feeding device in accordance with the present invention comprises a cassette for containing a stack of sheets, feeding means longitudinally advancing from the cassette for the uppermost sheet of the stack in pressing contact with the sheet at approximately its medial longitudinal axis, pawl members for separating the uppermost sheet from the other sheets by engaging the uppermost sheet at its opposite leading corners to thereby temporarily restrain the uppermost sheet from advancing, and pressure members for pressing the uppermost sheet at its opposite side portions to a predetermined extent, the pressure members being retractable from their pressing position in response to the resilient force of the sheet when the advancing sheet is bent by engagement with the separating pawl members.

In accordance with the preferred form of the improved feeding device each of the pressure members are mounted on the free end of an arm member pivotably attached to a side plate disposed within the cassette and each arm member is adjustingly movable in a direction parallel to the sheet feeding direction. Each pressure member is advantageously a rotatable roller.

Moreover, each of the pressure members and the respective separating pawl member opposed thereto are mounted on the free ends of respective separate individually swingable arm members, and a projection is provided on one or both the arm members so that when one of the arm members is intentionally swung beyond a predetermined point, the other arm member is caused to follow the swinging movement of that arm member.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
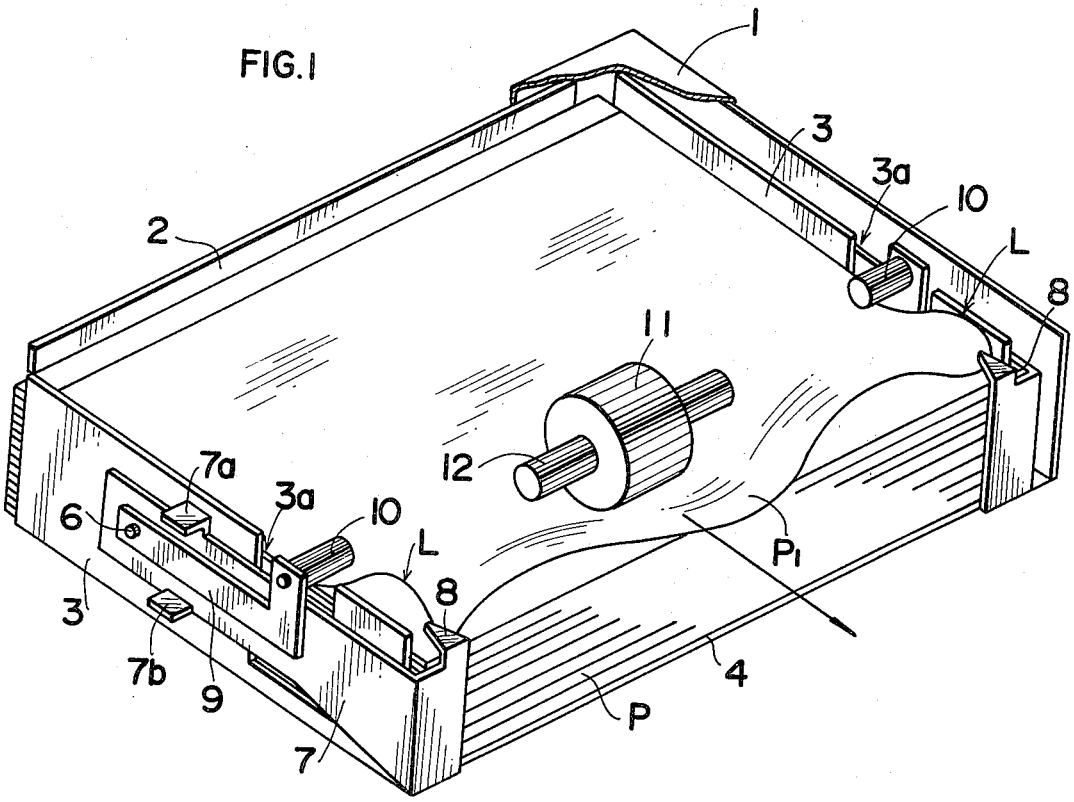
FIG. 1 is a perspective view of a sheet feeding device embodying the invention.
Figure 2:
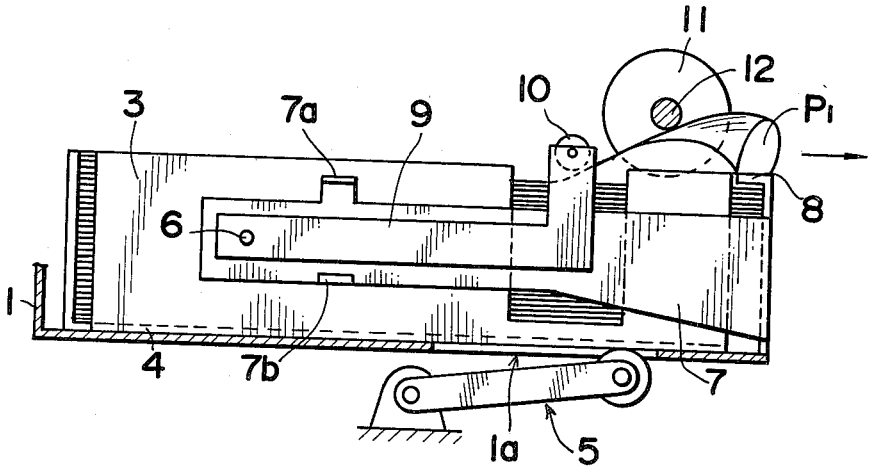
FIG. 2 is a side elevation view thereof.

With reference to the drawings, particularly FIGS. 1 and 2 which illustrate a preferred embodiment of the present invention, reference numeral 1 generally designates a cassette case in which a stack of sheets P is held and positioned by a rear restraining plate 2 and side plates 3, 3. Although not fully shown, the case 1 is of the known type. The case 1 has in its interior a bottom plate 4 having placed thereon and supporting the stack of sheets P, which is pressed against a feed roller, hereinafter described, by lift means 5. The lift means 5 is mounted on the main body of a copier and bears against the bottom plate 4 through an opening 1*a* formed in the bottom of the case 1.

An arm member 7 is supported by a pivot 6 on each of the side plates 3, 3 for swinging about a transverse axis and has a separating pawl member 8 at its free end. Under the influence of gravity, the separating pawl members 8, 8 are urged into pressing contact with the uppermost sheet P1 at the opposite corners of its leading end. The arm member 7 has outwardly directed upper and lower projections 7a and 7b respectively which are spaced from and engageable with corresponding edges of another arm member 9 swingably supported by the pivot 6. Each arm member 9 is swingable independently of the corresponding arm member 7 and has a free end carrying a pressure member, specifically an inwardly directed horizontal side roller 10. Each side roller 10 projects into the sheet accommodating space or portion through a vertical aperture 3a formed in the respective side plate 3 to downwardly press under the influence of gravity, the uppermost sheet P1 at the respective side border thereof. A feed roller 11 bearing on the uppermost sheet P1 under suitable pressure is mounted by a drive shaft 12 on the copier main body, approximately above the center or medial longitudinal axis of the sheets P with respect to the feeding direction. For feeding or advancing the uppermost sheet, the feed roller 11 is rotated counterclockwise as viewed in the drawings by unillustrated drive means.

With the sheet feeding device of the foregoing construction, the uppermost sheet P1 in contact with the feed roller 11 is advanced in the direction of the arrow when the roller 11 rotates in the counterclockwise direction. At this time, however, the leading end opposite corner portions of the sheet P1, which are restrained from advancing by the separating pawl members 8, 8, are bent or buckled to form upwardly convex bends L in rearwardly of the pawl members 8, 8 with espect to the feeding direction. On the other hand, the side rolles 10, 10 on the swingable arm members 9, 9 resiliently bear, under the influence of gravity, on the opposite side borders or portions of the uppermost sheet, thereby restraining the bends L formed in the rear of the separating pawl members 8, 8.

With the further rotation of feed roller 11, the leading end opposite corners of the sheet P1 are urged to pass over the separating pawl members 8, 8 permitting the individual uppermost sheet P1 to be advanced alone separated from the underlying sheets.

Generally, there is a likelihood with sheets of the same thickness, that the bends formed in the forwardly urged uppermost sheet are larger when the sheet has a greater density and a higher resiliency. If the bends exceed a certain extent without any restraint, the sheet fails to react in the manner required to pass over the pawl members and is misfed or improperly fed. With the device of the present invention, however, the side rollers 10, 10, which are in pressing contact with opposite side portions of the uppermost sheet at all times, permit the sheet to individually bend or buckle to a properly restrained form suitable for the sheet to pass over the pawl members. Further, if a highly resilient, thick sheet or the like is forcibly restricted to the same bent form as thin sheets, it is likely that the sheet will be folded or otherwise deformed, but with the device according to the present invention, the side rollers 10, 10 are suitably upwardly retractable in accordance with the degree of resiliency of the sheet and will not exert a pressure greater than that needed. Thus, folds or like faults will not result. Even in the event of a change in the size of sheets, the sheets of different size are bent to a proper form as restrained by the side rollers 10, 10, so that there is no need to consider the difference in the distance between the feed roller 11 and the separating pawl members 8, 8. Sheets of different sizes are therefore properly individually dispensed with the use of the single feed roller 11 which is disposed approximately centrally of the sheets with respect to the feeding direction.

Suitable access to the cassette so that it can be replenished with sheets is had simply by lifting either the arm members 7, 7 or the arm members 9, 9, since the other arm members are concurrently raised by the projections 7a or 7b formed on the arm members 7, 7.

Figure 3:
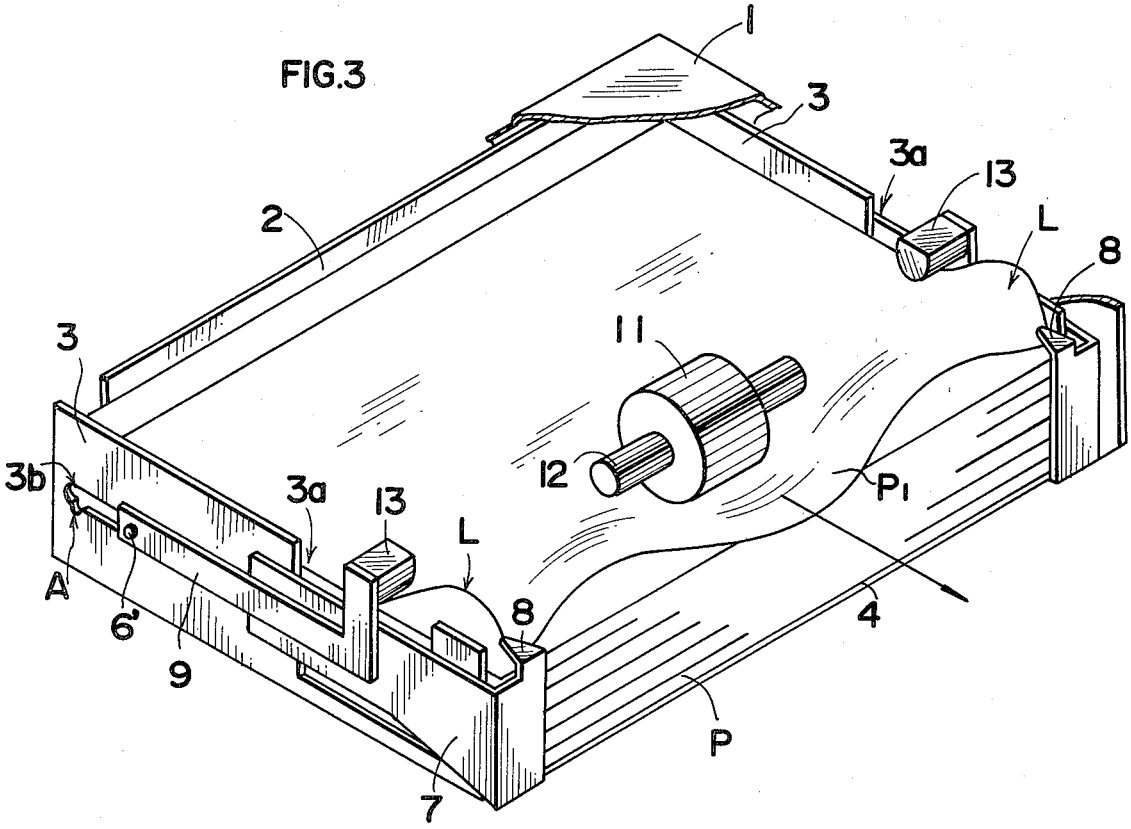
FIG. 3 is a perspective view of another embodiment of the present invention.
Figure 4:
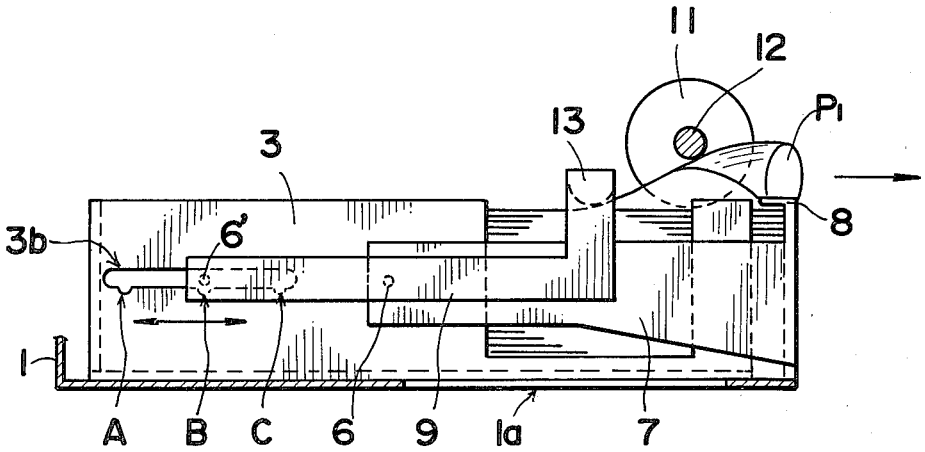
FIG. 4 is a side elevation view of the sheet feeding device of FIG. 3.

FIGS. 3 and 4 show another embodiment of the present invention which differs from the first embodiment in the manner hereinafter described, the present embodiment being otherwise similar to that first described. Indicated at 3b is a horizontal slot formed in each of the side plates 3, 3. The slot 3b has formed in its bottom edge longitudinally spaced recesses A, B and C. A pivot 6' engages the slot 3b and is slidable along the length thereof and fixedly positionable at the locations of the recesses. Each of the arm members 9, 9 are swingable about a respective pivot 6' and has a free end carrying a side inwardly projecting pressure member 13 with a curved underface.

With the aforesaid last described sheet feeding device, each pivot 6' is selectively fixedly positioned at the rear recess A for relatively thick sheets, at the intermediate recess B for the common or usual sheets, or at the forward recess C for relatively thin sheets, whereby the position where the side member 13 restrains the sheet for proper bending can be altered as desired according to the resiliency of the sheet. Since the higher the resiliency, the greater should the sheet be bent, so that the device assures an optimum bent form at all times even for such resilient sheets.

While the rotable side rollers 10 of the first embodiment provides very low resistance to the feed advancing sheet and therefore permits a very satisfactory feed of the sheet, the same effect can be achieved by simplified means according to the second embodiment, that is, by the side member 13 having a curved underface which contacts the sheet with a relatively low resistance or frictional drag.

Although the embodiments described above include only one feed roller disposed at the center of the sheet, it is possible to use feed means comprising two rollers which are arranged side by side approximately centrally of the sheet.

As is apparent from the foregoing description, sheets are always uniformly individually properly fed by the device of the present invention since the sheet being advanced is bent or buckled to a suitably adjusted or regulated form irrespective of the size or properties of the sheet. The mechanism of the present invention has also obviated the inconvenient, awkward and expensive requirements of many of the earlier feeding means which must be prepared for use in different countries.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included herein.

What is claimed is:

1. A sheet feeding device comprising:

a casette for holding a stack of sheets;

feeding means for longitudinally advancing from the cassette the uppermost sheet of the stack in pressing contact with the sheet at approximately its medial longitudinal axis;

separating pawl members for separating the uppermost sheet from the other sheets by engaging the uppermost sheet at its opposite leading corners; and pressure means for pressing the uppermost sheet at its opposite side portions and being retractable, at least in part independently of any moement of said pawl members from the pressing position in response to the resilient force of the uppermost sheet when the uppermost sheet is bent by its advance in engagement with the separating pawl members;

whereby the sheet is properly discharged regardless of the size or thickness or resiliency of the sheet.

2. A sheet feeding device as claimed in claim 1, including side plates disposed within the cassette, said pressure means being mounted to each of said side plates.

3. A sheet feeding device as claimed in claim 2, said pressure means comprising a first arm member pivotally attached to each of said side plates and a pressure member mounted on a free end of each of said arm members.

4. A sheet feeding device as claimed in claim 3, wherein said pressure member comprises a rotatable roller member.

5. A sheet feeding device as claimed in claim 3, wherein said pressure member has a curved underface which contacts said uppermost sheet with relatively low resistance.

6. A sheet feeding device as claimed in claim 3, including second arm members mounted to respective side plates for swinging about the pivot axis of said first arm members, said separating pawl members being formed on the free end of each of said second arm members.

7. A sheet feeding device as claimed in claim 1, wherein said pressure means is longitudinally adjustably movable.

8. A sheet feeding device as claimed in claim 7, including side plates disposed within said cassette, said pressure means being mounted to each of said side plates and including an arm member pivotally attached to each of said side plates as to be longitudinally adjustably movable and a pressure member mounted on a free end of each of said arm members.

9. A sheet feeding device as claimed in claim 8, wherein each of said side plates has a longitudinal horizontal slot and each of said arm members includes a pivot longitudinally slidably engaging a respective slot and plurality of recesses formed at predetermined positions along each of said slots for selectively engaging and fixedly positioning respective pivots.

10. A sheet feeding device as claimed in claim 8, wherein said pressure member includes rotatable roller member.

11. A sheet feeding device as claimed in claim 8, wherein said pressure member has a curved underface which contacts the uppermost sheet with relatively low longitudinal sliding resistance.

12. A sheet feeding mechanism comprising;

means for holding a stack of sheets;

advancing means for applying a longitudinal advancing force to the uppermost sheet of said stack in the vicinity of the medial longitudinal axis of said sheet;

restraining means for releasably restraining the longitudinal advance of the leading corners of said uppermost sheet whereby to buckle said uppermost sheet during the initial advance thereof; and pressure members bearing on the side borders of said uppermost sheet and being movable independently, at least in part, of movement of said restraining means, to a raised position in response to the buckling of the portions of said sheets underlying said pressure members.

13. The mechanism of claim 12 wherein said restraining means comprises a projection overlying each of said uppermost sheet leading corners.

14. The mechanism of claim 12 including a pair of arms swingable about a transverse axis, said pressure members being mounted proximate the free ends of respective arms.

15. The mechanism of claim 12 wherein said pressure members are longitudinally adjustable.

* * * * *